US006916071B2

(12) United States Patent
Harman et al.

(10) Patent No.: US 6,916,071 B2
(45) **Date of Patent: *Jul. 12, 2005**

(54) MINING SYSTEM

(76) Inventors: Jeffrey K. Harman, P.O. Box 252, Pounding Mill, VA (US) 24637; Joey W. Harman, P.O. Box 586, Rosedale, VA (US) 24280

( * ) Notice: Subject to any disclaimer, the term of this patent is extended or adjusted under 35 U.S.C. 154(b) by 0 days.

This patent is subject to a terminal disclaimer.

(21) Appl. No.: 10/801,382

(22) Filed: Mar. 16, 2004

(65) Prior Publication Data

US 2004/0174064 A1 Sep. 9, 2004

Related U.S. Application Data

(63) Continuation of application No. 10/183,741, filed on Jun. 26, 2002, now Pat. No. 6,796,616.

(51) Int. Cl.[7] ..... E21C 37/00
(52) U.S. Cl. ..... 299/19; 299/18; 299/10
(58) Field of Search ..... 299/19, 18, 10, 299/33

(56) References Cited

U.S. PATENT DOCUMENTS

| | | | |
|---|---|---|---|
| 4,017,122 | A | 4/1977 | Simpson |
| 4,232,904 | A | 11/1980 | Hurd |
| 4,260,195 | A | 4/1981 | Hart |
| 4,505,517 | A | 3/1985 | Seddon et al. |
| 4,952,000 | A | 8/1990 | Lipinski et al. |
| 5,033,795 | A | 7/1991 | Farrar et al. |
| 5,782,539 | A | 7/1998 | Peterson |

OTHER PUBLICATIONS

Jerry Tien, P.E., Longwall Caving in Thick Seams, Coal Age, Apr. 1998, pp. 52–54.
J. Richard Lucas, Christopher Haycocks, SME Mining Engineering Handbook, vol. 1, Section 12—Underground Mining Systems and Equipment, 1973, pp. 12–2 thru 12–262.
Eugene P. Pfleider, SME Mining Engineering Handbook, vol. 2, Section 19—Planning and Designing for Mining Conservation, 1973, pp. 19–2 thru 19–23.
Syd S. Peng, Ph.D., Coal Mine Ground Control, Chapter 2—Mine Layouts and Ground Control Practices in Underground Coal Mines, pp. 5–40.
John L. Schroder, Jr., Elements of Practical Coal Mining, Chapter 14—Modem Mining Methods—Underground, 1973, pp. 346–376.
Nicholas P. Chironis, Coal Age Operating Handbook of Underground Mining, vol. 1—Coal Age Library of Operating Handbooks, 1977, pp. 1–103.
Skelly and Loy, Environmental Assessment of Surface Shortwall Mining, Dec. 21, 1979, pp. 1–180 and attached Appendices.
Robert H. Trent, William Harrison, Underground Mining Methods Handbook, Longwall Mining, 1982, pp. 790–849.
R. H. Trent, Kenneth P. Katen, Underground Mining Methods Handbook, Shortwall Mining, 1982, pp. 850–871.

*Primary Examiner*—John Kreck
(74) *Attorney, Agent, or Firm*—Patton Boggs LLP

(57) ABSTRACT

A method for extracting mineral deposits is provided. First, a predetermined surface is contour mined to expose a portion of a mineral seam and provide an insertion highwall between a pair of endwalls. Successive mining passes are made through the mineral seam to extract the mineral deposits by moving from one endwall to the other endwall. Advancement of the mining operation occurs in a direction substantially perpendicular to the insertion highwall.

48 Claims, 17 Drawing Sheets

MINING SYSTEM

CROSS-REFERENCES TO RELATED APPLICATIONS

This application is a continuation of prior U.S. application Ser. No. 10/183,741, filed Jun. 26, 2002, now U.S. Pat. No 6,796,616, which is hereby incorporated herein by reference.

BACKGROUND OF THE INVENTION

1. Field of the Invention

The present invention relates, in general, to a mining system for extracting mineral deposits, and more specifically, but without limitation, to a mining system utilizing a combination of surface contour mining and underground shortwall or longwall mining systems.

2. Description of Related Art

Conventional surface mining systems have devastating environmental results. In hilly or mountainous regions, surface contour mining is accomplished by removing timber and clearing the area to be mined, making a strip cut to form a substantially horizontal bench and a vertical highwall that exposes the seam of mineral deposits to be removed. Another technique is to simply remove the entire top portion of the mountain to extract the minerals deposited below.

Underground mining systems are less damaging to the environment, but more costly and inefficient with lower production rates. When underground mining systems are used to extract mineral or coal deposits from a mineral or coal reserve 10, the reserve 10 is divided into panels 12 as shown in FIG. 1 which are laid out and developed for both shortwall mining and longwall mining operations. Coal reserves conducive to mining adjacent parallel panels (Panels 1 to 8 as shown in FIG. 1) are most desirable because they facilitate panel development and allow shorter equipment moves. As can be seen, the panels 12 are generally rectangular in shape having gate entries 14 (a headgate and tailgate) extending along each length, and are all connected at one end by main entries 16. In modern mining systems, these panels 12 are developed using continuous miner units. In modern longwall mining systems, panels typically range from 400 to 1200 feet in width and from 4,000 to 15,000 feet in length. In modern shortwall mining systems, the shortwall panels typically range from 100 to 200 feet in width and from 2,000 to 4,000 feet in length. Production of coal or other sedimentary deposits begins at one end of the panel 12, the starter entry 18, to mine the seam along its face or wall in the direction indicated by the arrow 19.

Referring more specifically to FIG. 2, panel 1 of FIG. 1 is shown in more detail as panel 20 having headgate entries 22*a–c*, collectively the headgate 22, and the tailgate entries 24*a–c*, collectively the tailgate 24, referred to above. While the direction of mining proceeds in the direction indicated by the arrow 19, production or plowing of the coal always proceeds from the headgate 22 to the tailgate 24 in the direction shown by the arrow 25 for both longwall and shortwall mining systems as will be described below in more detail. A "three-entry" development system utilizes the three maingate entries 16*a–c*, collectively the maingate 16, the three headgate entries 22*a–c*, and the three tailgate entries 24*a–c* that are commonly used to provide the necessary airways and escape ways and other functions. The system permits installation of belt and track in the center entry, and allows one outer entry to be used as a return airway. This system is complex and expensive to develop, and is well-known in the mining business.

Upon completing development of the panels 12, the longwall or shortwall mining of the panel 20 commences as shown in FIGS. 3 and 4, respectively. Referring more specifically to FIG. 3, longwall machinery 30 and miners are protected by roof supports 32, 33 designed to withstand tremendous overburden pressures. The material containing the minerals is cut from the face of the seam by a plough or shearer 34 of the longwall machinery 30 and drops onto an armored chain conveyor system (not shown) for transport to a main conveyor system 36, which in turn transports the material to the surface. As successive cuts are made along the face of the seam from the headgate 22 to the tailgate 24 in the direction of production indicated by the arrow 25, the roof supports 32, 33 and armored chain conveyor are advanced into the seam in the direction of mining indicated by the arrow 19, allowing the overburden to collapse or cave-in behind the roof supports 32,33 to form what is known as a gob 38 of loosely-packed material. The roof supports 32,33 not only advance in the mining direction, but also are extendable as known in the art with the supports 32 being shown in the extended configuration and the supports 33 being shown in the retracted configuration.

Referring more specifically to FIG. 4, shortwall machinery 40 and miners are also protected by roof supports 42,43 designed to withstand tremendous overburden pressures. Unlike the longwall miner which ploughs the seam parallel to its face, a shortwall miner cutting head 44 of the shortwall machinery 40 which is approximately 10 to 12 feet in width plows in a direction generally perpendicular to the face of the seam and drops the material onto an armored chain conveyor system (not shown) for transport to a main conveyor systems 46, which in turn transports the material to the surface. As successive cuts are made along the face of the seam from the headgate 22 to the tailgate 24 in the direction of production indicated by the arrow 25, the roof supports 42,43 and armored chain conveyor are advanced into the seam in the direction of mining indicated by the arrow 19, allowing the overburden to collapse or cave behind the roof supports 42,43 forming the gob 48. The roof supports not only advance in the mining direction as shown by supports 42*a* and 42*b*, but also are extendable as known in the art with supports 42 being shown in the extended configuration and supports 43 being shown in the retracted configuration. The shortwall mining system requires significantly less capital and is more flexible in handling geological conditions that vary through the mineral reserve. The only significant disadvantage of the shortwall mining system is that the production rate is somewhat lower as compared to the longwall mining system.

It should be apparent from the above, the primary problem associated with underground longwall and shortwall mining systems is the cost and time associated with developing and creating the panels, and then moving either system from panel to panel underground to mine the entire mineral reserve 10. The moves from panel to panel result in many days of downtime at a high cost to the mining operation. The ingress and egress entries and ventilation associated with the system are all expensive. Time travel to the seam face for the miners is also a significant cost associated with these systems.

Moreover, federal legislation (e.g., Clean Water Act) restricts the use of waste rock produced by large scale surface mining systems as "fill material" legitimately disposed of at other locations. Recent court decisions have held that excess spoil generated by mining operations is waste that does not qualify as fill material that can disposed of as valley fills. Thus, the disposal of excess spoil is a significant problem.

SUMMARY OF THE INVENTION

Apparatus and method for extracting mineral deposits is provided by combining surface contour mining with underground longwall or shortwall mining techniques. More specifically, such apparatus and method uses surface contour mining to create a staging bench and highwall for inserting either shortwall or longwall mining equipment into the seam of a mineral reserve to commence a continuous mining operation without the need for developing separate underground panels. The highwall formed at the point of insertion, the insertion highwall, extends between opposing highwalls formed on either side of the insertion highwall and generally in parallel to the direction of production and perpendicular to the direction of mining. A continuous miner is used to develop a starter entry cut into the seam extending along the entire length of the insertion highwall. Roof supports are advanced into the starter entry cut as formed by the continuous miner across the insertion highwall, and are then covered with spoil as they advance into the starter entry cut to form a starter passage sealed at both ends by a canopy. The longwall or shortwall mining commences inside the starter passage moving in either direction between the opposing highwalls that operate as "endgates" and function as either a headgate or a tailgate for the mining system depending upon the direction of production travel.

The above-identified problems are solved because the mining system is easily inserted, accessed and extracted from the surface by means of stable opposing highwalls and bench area created by contour surface mining. In addition to reducing the move time, such apparatus and method nearly eliminates travel time of the miners to the face of the seam and eliminates the need for developing panels and entries to the panels. Ingress and egress entries and ventilation entries are all much simpler and more efficient because they are provided at the opposing highwalls formed above ground on the bench rather than underground moving with successive passages formed therebetween by the face of the seam, the roof support, and the gob as the mining progresses into the seam.

Additionally, the mining operation is not restricted to production from the headgate to the tailgate, but can be adapted to move back and forth in both directions between the opposing highwalls on both sides of the ridge or mountain with full seam extraction across the entire length of the face. This eliminates the need for development entries and permanent roof supports and simplifies face ventilation. Furthermore, roof supports can be easily added or removed from the mining system to accommodate changes in the face width of the entire mineral deposit of the mineral reserve. The instant invention also reduces the volume of excess spoil that must be disposed of as a result of the mining operation.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF THE PRESENT INVENTION

Figure 5:
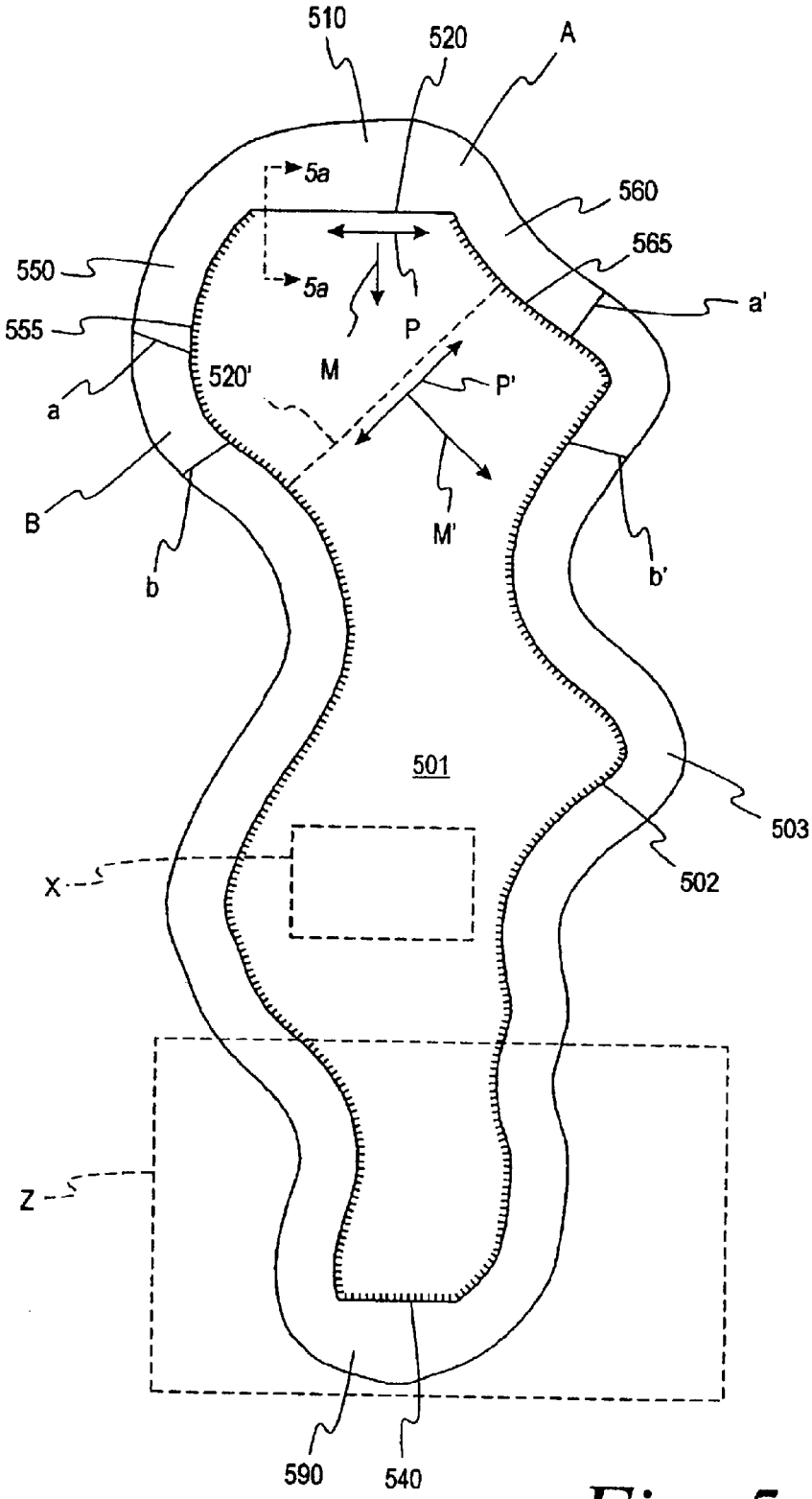
FIG. 5 is an enlarged top plan view of the mining system according to one embodiment of the present invention.

The present invention provides an economical, convenient mining system adapted to quickly and efficiently remove mineral deposits from a mineral reserve with minimal downtime. Apparatus and methods for extracting the mineral deposits are provided by combining surface contour mining with underground longwall or shortwall mining techniques. Referring more specifically to a mineral reserve 501 in FIG. 5, the mining system of the present invention utilizes surface contour mining to create a stable highwall 502 and bench area 503 around the mineral reserve 501 to allow insertion of the mining system underground. The surface contour mining, however, is conducted in stages commencing with mining area A between lines a and a', then mining area B advancing to lines b and b', followed by subsequent surface contour cuts advancing in increments of about 200 feet to 500 feet for each mining area to the end of the mineral reserve 501. The bench area 503 is typically between 80 to 100 feet wide.

Figure 1:
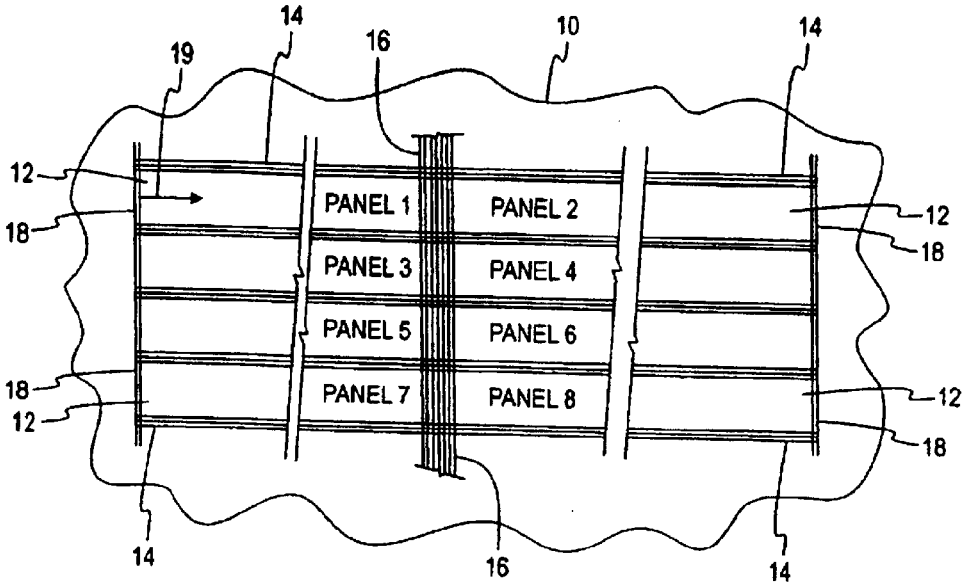
Fig. 1 (Prior Art)
FIG. 1 is a top plan view of an exemplary mineral reserve laid out in parallel panels.
Figure 2:
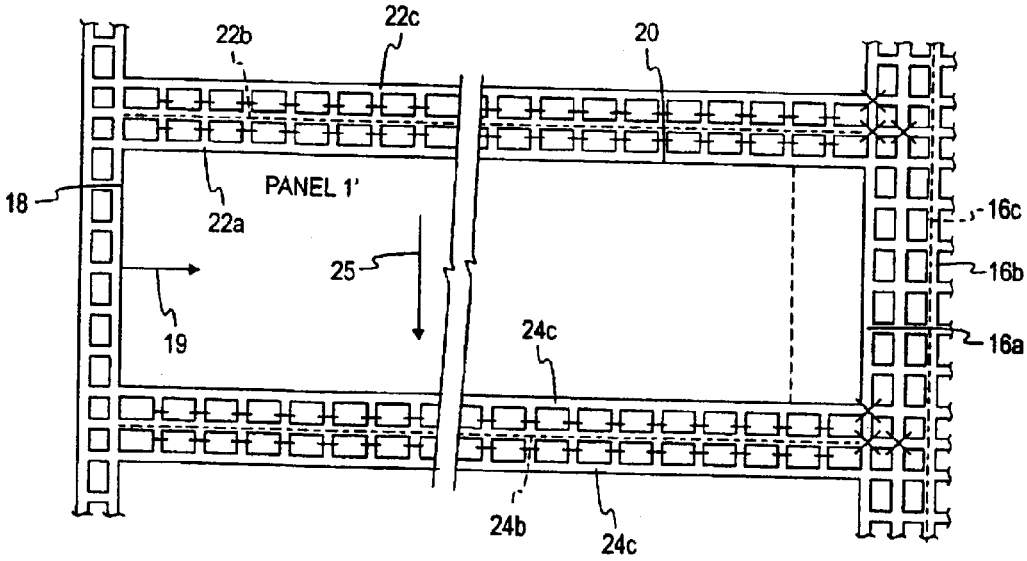
Fig. 2 (Prior Art)
FIG. 2 is an enlarged top plan view of one of the panels of the mineral reserve of FIG. 1.
Figure 3:
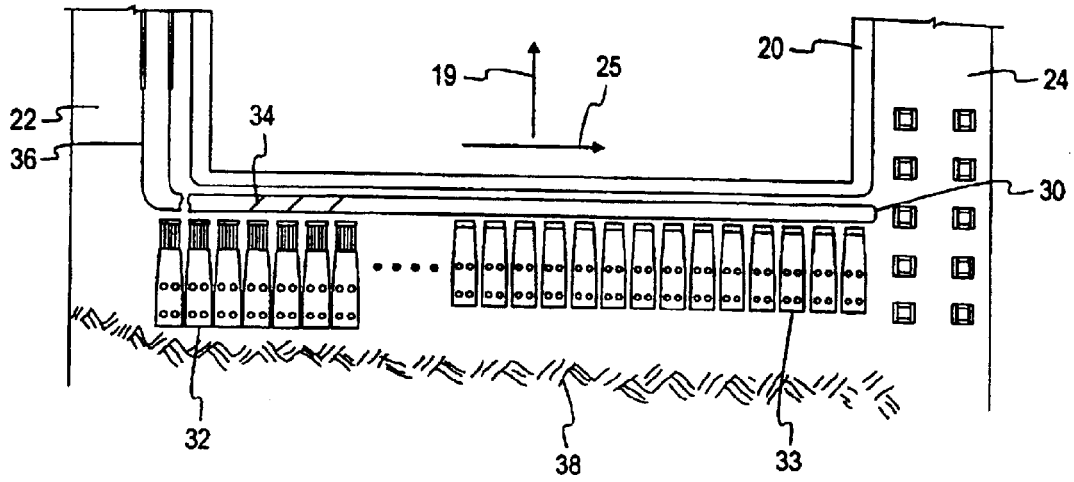
Fig. 3 (Prior Art)
FIG. 3 is an enlarged top plan, partial view of the panel of FIG. 2 after the commencement of longwall mining.
Figure 4:
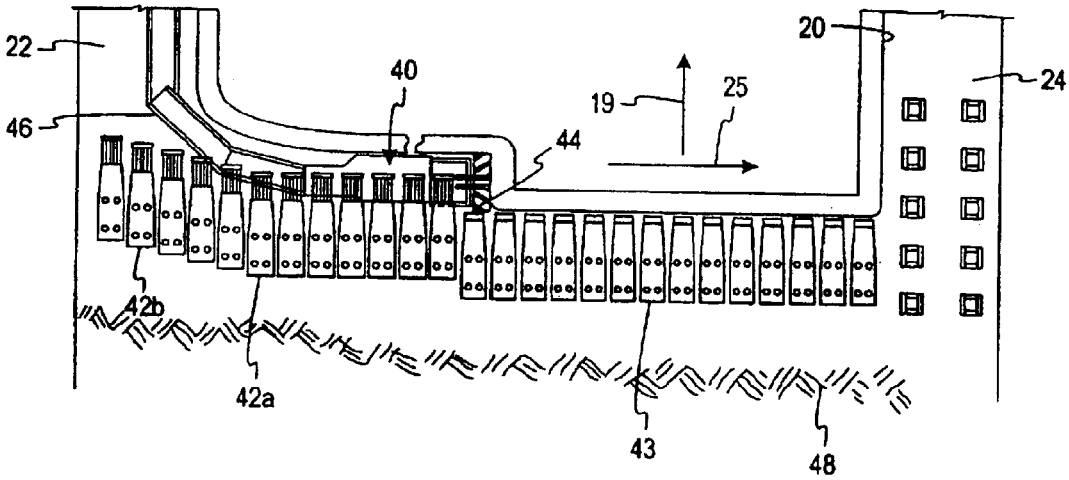
Fig. 4 (Prior Art)
FIG. 4 is an enlarged top plan, partial view of the panel of FIG. 2 after the commencement of shortwall mining.
Figure 5A:
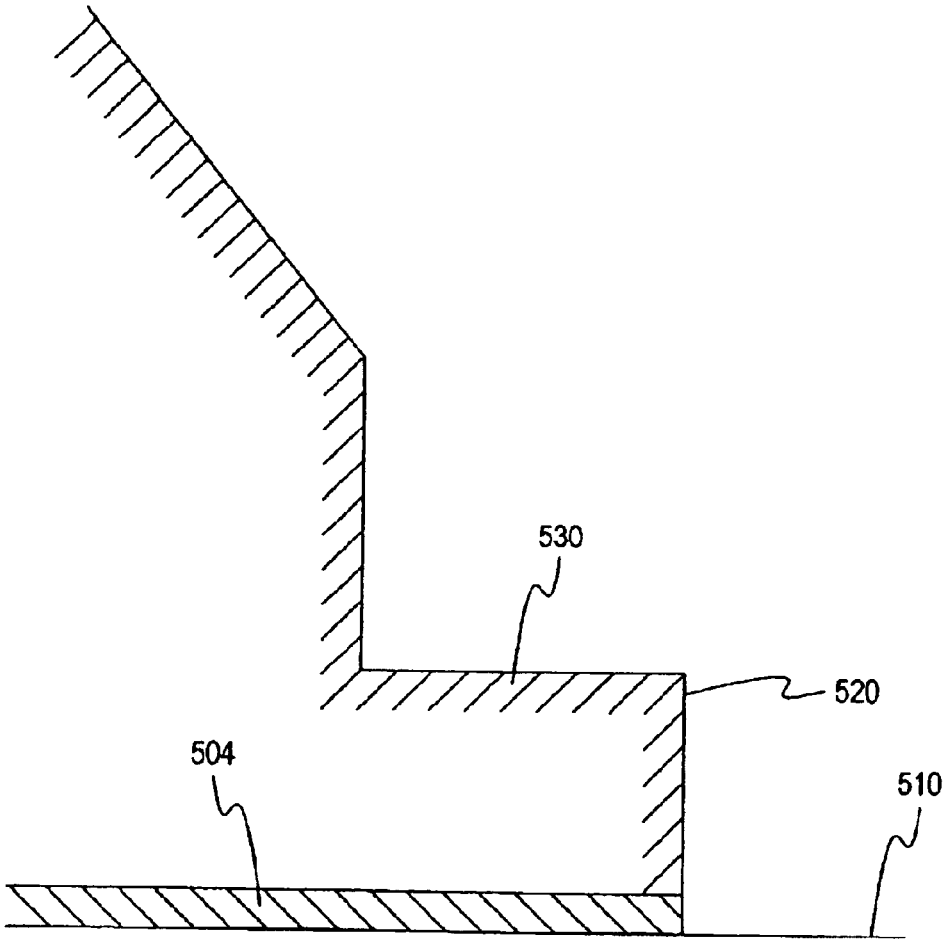
FIG. 5A is a cross-sectional view taken along line 5A—5A of FIG. 5.

Referring also to FIG. 5A, the mining system commences by using surface contour mining to make the initial surface contour cut in mining area A by creating (i) a bench for supporting mining equipment, the staging bench 510, and (ii) a stable highwall to allow insertion of the equipment into a seam 504 of the mineral reserve 501 underground, the insertion highwall 520, to commence a continuous mining operation without the need for developing separate underground panels 12 (see FIG. 1). Although a longwall or shortwall mining system can be used, a shortwall continuous mining operation is disclosed in complete detail, and a longwall mining operation is disclosed (FIGS. 13 and 13A) to the extent different from the shortwall operation. Material excavated from the initial cut in mining area A will be disposed of on an existing bench or used as excess spoil fill. The height of the insertion highwall 520 may be about 40 feet with a safety bench 530 cut above the insertion highwall 520. It is important that this initial cut be laid out as straight as possible to eliminate any problems with equipment insertion underground.

Referring back to FIG. 5, the insertion highwall 520 is generally perpendicular to the direction that the mining will advance as indicated by the arrow M and generally parallel to the direction of mineral production as indicated by the double arrow P. With respect to shortwall mining, the cutting bits of the shortwall miner will be oriented in a direction generally perpendicular to arrow M. The initial surface contour cut includes a stable highwall and bench area on both sides of the staging area, i.e., the bench 550 and opposing highwall 555 on one side, and the bench 560 with opposing highwall 565 on the other side. The insertion highwall 520 extends between the opposing highwalls 555, 565. Although the system as described above proceeds generally in the direction indicated by arrow M, in certain situations, it may be necessary to shift the direction of production, and P may need to change as indicated by the double arrow P' so that the production path is as short as possible. The opposing highwalls 555, 565 are still generally parallel to the shifted direction of mining as indicated by the arrow M'. It is appreciated that this system provides for shifts in relatively any direction, and therefore is completely adaptable to the changes in the mineral seam 504 in a selected region. Because the system is designed for quick relocation, a user can appreciate the advantages of the present system.

As the mining system advances into the mineral seam 504 (FIG. 5A), with changes in production direction being implemented in a manner as described above when necessary, contour mining continues in advance of production until the end of the mineral seam 504 is reached. The contour mining establishes an exit bench 590, which has been formed in accordance with the principles discussed above with respect to the staging bench 510. An equipment extraction highwall 540 has also been formed, and is made in accordance with the insertion highwall 520 as shown in FIG. 5A. As the miner makes its final cut through the mineral seam 504, the mining equipment is removed from the mineral reserve 501 in a manner described in more detail below. Note that the entire mineral reserve 501 does not have to be completed (i.e., the mining operation could commence with mining area A and move to mining area Z to avoid any destruction of mining area X in accordance with ordinary mining design methods).

Figure 6:
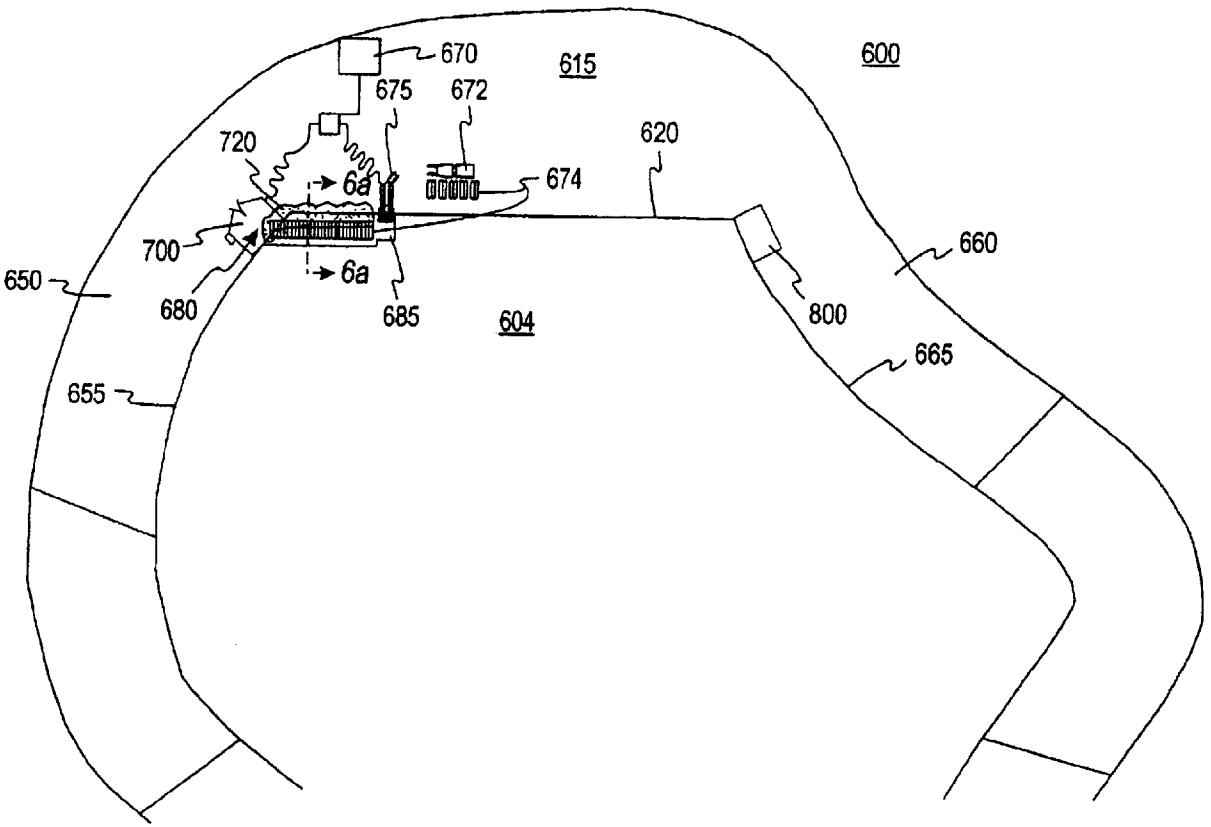
FIG. 6 is an enlarged top plan view of the mining system of FIG. 5 during an initial setup and equipment insertion phase according to one embodiment of the present invention.

Referring now to FIGS. 6–12A in general, there is shown differing phases for the use of the mining system according to the principles of the present invention as described above and utilizing exemplary shortwall mining techniques. Referring specifically to FIG. 6, a top plan view of the initial setup and equipment insertion phase 600 for an exemplary shortwall mining system is shown. A staging bench 610 is first formed after contour mining the mineral seam 604 in accordance with the principles discussed above. An equipment staging area 615 is formed at an insertion highwall 620. As described above, the contour mining includes a stable highwall, which are also referred to as endwalls, and bench area on both sides of the equipment staging area 615, i.e. the bench 650 and highwall 655 on one side, and the bench 660 and highwall 665 on the other side. The opposing highwalls 655, 665 in the area being mined operate as endgates, and may function as either a headgate or a tailgate, described hereinabove, for the mining system depending on the direction of production travel. This is an important advantage, as the invention described herein eliminates the necessity of independent headgates or tailgates required by prior art systems, which reduces mining costs considerably. A power substation 670 may be set up in the equipment staging area 615 to provide power to various parts of the system.

In the equipment insertion phase 600, a continuous miner 675 makes initial cuts in the mineral seam 604 to form a starter entry 680. After several successive cuts are made beginning at the starter entry 680, and moving from one highwall 655 to the opposing highwall 665, an insertion passage 685 is formed. Shield carrier 672 is allowed to insert roof supports 674 behind the area mined by the continuous miner 675. The roof supports 674 are shown in the equipment staging area 615 after being placed in the starter entry 680 and starter passage 685, and also ready for placement by the shield carrier 672. An intake canopy 700 and an exhaust canopy 800 are placed at the substantially opposing highwalls 655, 665 as defined by the insertion highwall 620.

Mine spoil 720 developed during creation of the access benches 650, 660 is placed on and around the roof supports 674 to complete the formation of the starter passage 685. This use of excess mine spoil 720, which effectively seals the starter passage 685 and creates a ventilation pathway within the starter passage 685 eliminates the need to transport the mine spoil 720 to disposal locations. This expedient use of the mine spoil 720 complies with recent court decisions, particularly those involving the Clean Water Act, by providing an immediate use for the mine spoil 720, as opposed to prior systems which typically dispose of mine spoil 720 within valley fills. Accordingly, an immediate benefit of the present invention is to eliminate the need for disposal locations by placement and use of the mine spoil 720 generated during the mining process.

Figure 6A:
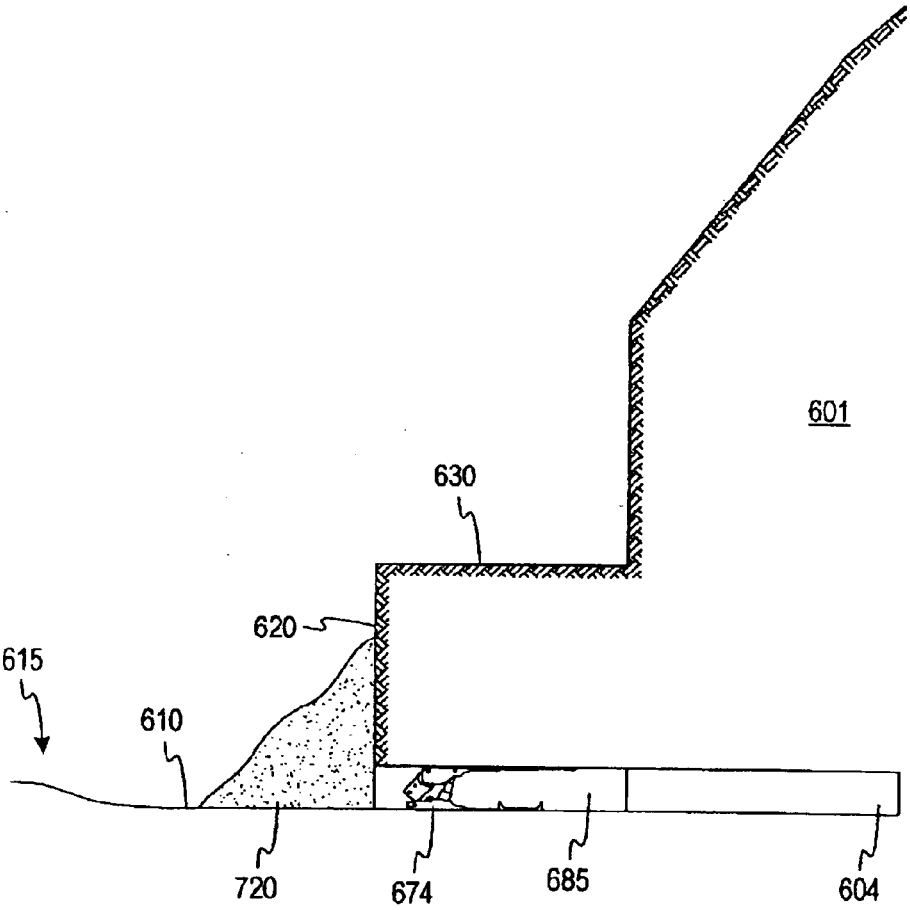
FIG. 6A is a cross-sectional view taken along line 6A—6A of FIG. 6.
Figure 7B:
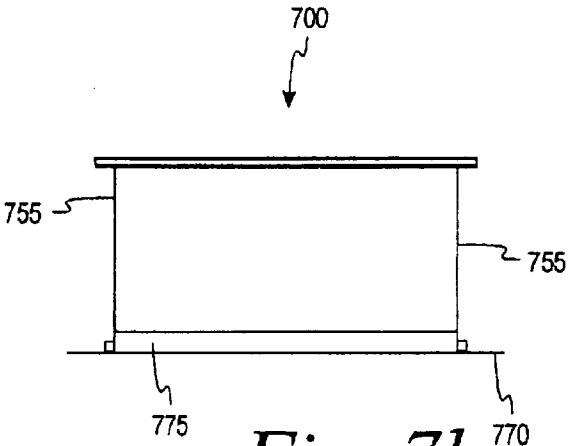
FIGS. 7A and 7B are respective front and side views of an embodiment of an intake canopy.
Figure 7A:
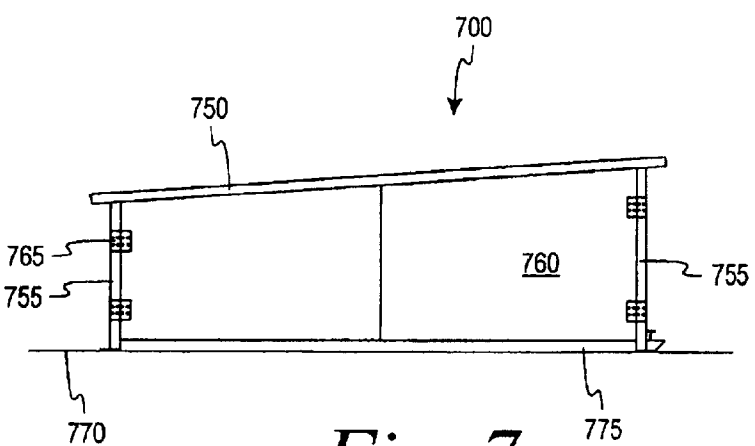
Figure 8B:
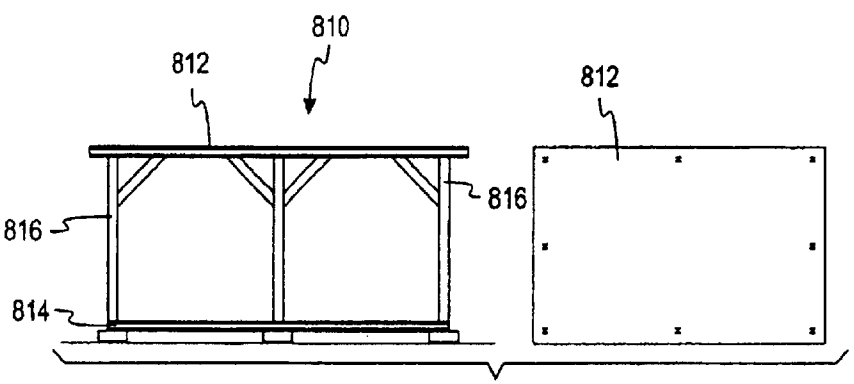
FIGS. 8A and 8B are respective front and side views of an embodiment of an exhaust canopy.
Figure 8A:
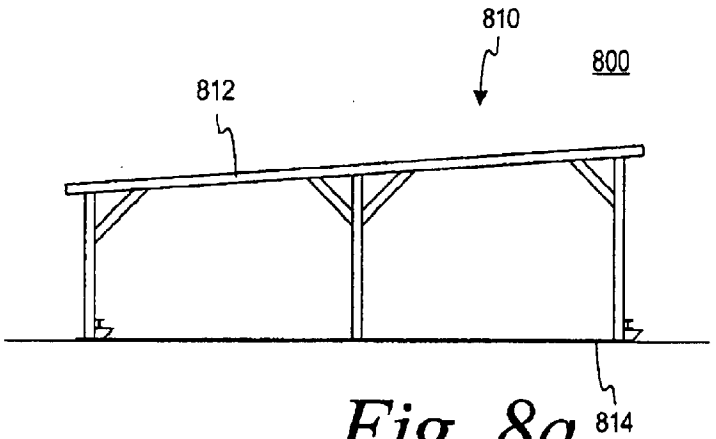

Referring now to FIG. 6A, a cross-section of the phase 600 taken along lines 6A-6A of FIG. 6 is shown. The staging bench 610 is shown formed below the equipment insertion highwall 620. A safety bench 630 is shown formed adjacent the equipment insertion highwall 620 and the existing mountaintop 601. The mine spoil 720 is shown surrounding the starter passage 685 adjacent the roof supports 674 as the continuous miner 675 (FIG. 6) completes cuts between the highwall 655 and opposing highwall 665 (FIG. 6). The mine spoil 720 creates an effective seal of the starter passage 685, which allows proper ventilation of the starter passage 685 and successive cuts into the mineral seam 604. Roof supports 674 are shown in the starter passage 685 adjacent to the mineral seam 604 and supporting the safety bench 630 in the area adjacent the equipment insertion highwall 620. As can be seen, the roof supports 674 have been advanced into the area mined by the continuous miner 675 (FIG. 6).

Referring now to FIGS. 7A–7B, and FIGS. 8A–8B, the intake canopy 700 and exhaust canopy 800 are shown in exemplary front and side views, respectively. The placement of the intake canopy 700 and exhaust canopy 800 during mining operations facilitates ventilation during operation of the present invention, and provides a convenient location for insertion and removal of the continuous miner 675, and also provides for safe ingress and egress into the mining area as required by the Mine Safety and Health Administration (MSHA). Accordingly, it is preferable that both the intake canopy 700 and exhaust canopy 800 allow air to flow between the intake canopy 700 and exhaust canopy 800 in order to facilitate ventilation of the area between the intake canopy 700 and exhaust canopy 800.

The intake canopy 700 includes a roof 750, preferably comprised of steel plating, support columns 755 coupled to the roof 750, at least one door 760 for sealing the canopy 700. The door 760 may be coupled to the intake canopy 700 via hinges 765 or other suitable coupling means. A base 770 is coupled to the columns 755 opposite the roof 750. A mining belt 775 may be coupled to the doors and extending along the base 770 to facilitate an air seal during operation to insure proper ventilation. The exhaust canopy 800 includes a roof 812, preferably comprised of steel plating, a base 814, and columns 816 coupling the roof 812 to the base 814. In certain preferred embodiments, the columns are I-beams comprised of steel. Likewise, the roof 812 and base 814 may be I-beams for structural integrity.

Although not specifically shown, the exhaust canopy may include doors in a manner described above. Because the intake canopy 700, exhaust canopy 800, and mine spoil 720 (FIGS. 6 and 6A) create an effective air seal, the intake canopy 700 and, if desired, the exhaust canopy 800 may be provided with a reversible ventilation fan such that the direction of ventilation may be reversed or re-oriented depending on the production direction. The ventilation fan is described in more detail herein below.

Figure 9:
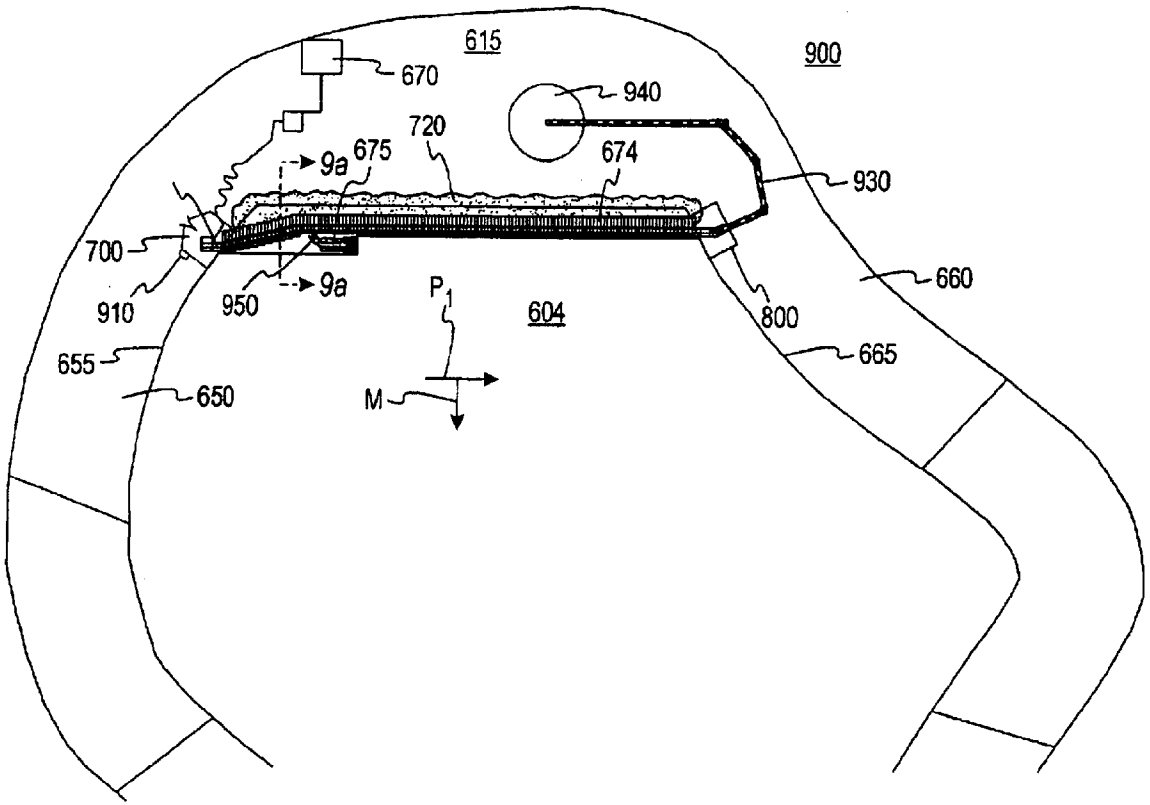
FIG. 9 is a top plan view of an initial production phase according to one embodiment of the present invention, which follows the initial setup and equipment insertion phase of FIG. 6.

Referring now to FIG. 9, a top plan view of an initial production phase 900, which follows the initial setup and equipment insertion phase 600 for the exemplary mining system of FIG. 6 is shown. In the instant production phase 900, the starter passage 685 has been completed and mine spoil 720 has been placed in the manner described above to form an air seal between substantially opposing highwalls 655, 665. A ventilation fan 910 is shown attached to the intake canopy 700 to effectively ventilate the cutting area between the intake canopy 700 and exhaust canopy 800. A conveyor system 920 is shown at one end of the roof supports 674 for conveying mined material to the exhaust canopy 800, and is coupled to a second conveyor system 930 for transport of the mined material to an outside stockpile 940. The intake canopy 700 and exhaust canopy 800 are shown advanced forward along the outside of the mineral seam 604 relative to FIG. 6, but such advancement is not required during this phase 900. The continuous miner 675 advances into the mineral seam 604 and moving from one highwall 655 to the opposing highwall 665. The roof supports 674 behind the continuous miner 675 advance from highwall 655 in the direction indicated by arrow M after the continuous miner 675 has advanced into mineral seam 604 towards highwall 665 in the direction indicated by arrow $P_1$. The continuous miner 675 may have a boom 950 or the like to transport mined material to the conveyor system 920. The mine spoil 720 has been placed along substantially opposing highwalls 655, 665 at the immediate area previously mined during creation of the starter passage 685, and after advancement of the intake canopy 700 and exhaust canopy 800.

Figure 9A:
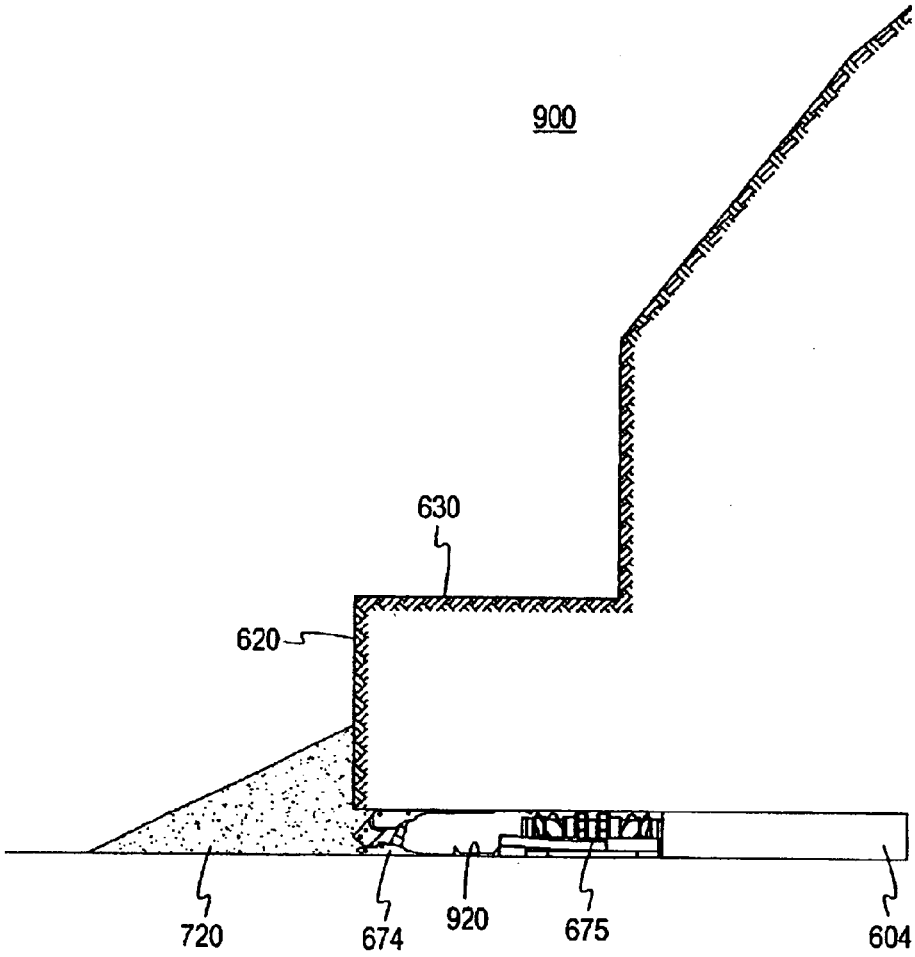
FIG. 9A is a cross-sectional view taken along line 9A—9A of FIG. 9.

Referring now to FIG. 9A, a cross-section of the phase 900 taken along line 9A—9A of FIG. 9 is shown. The mine spoil 720 is shown surrounding the roof supports 674 to facilitate the formation of the air seal along the equipment insertion highwall 620 and between opposing highwalls 655, 665, which allows the ventilation fan 910 to effectively ventilate the area between the intake canopy 700 and the exhaust canopy 800 (FIG. 9).

Figure 10:
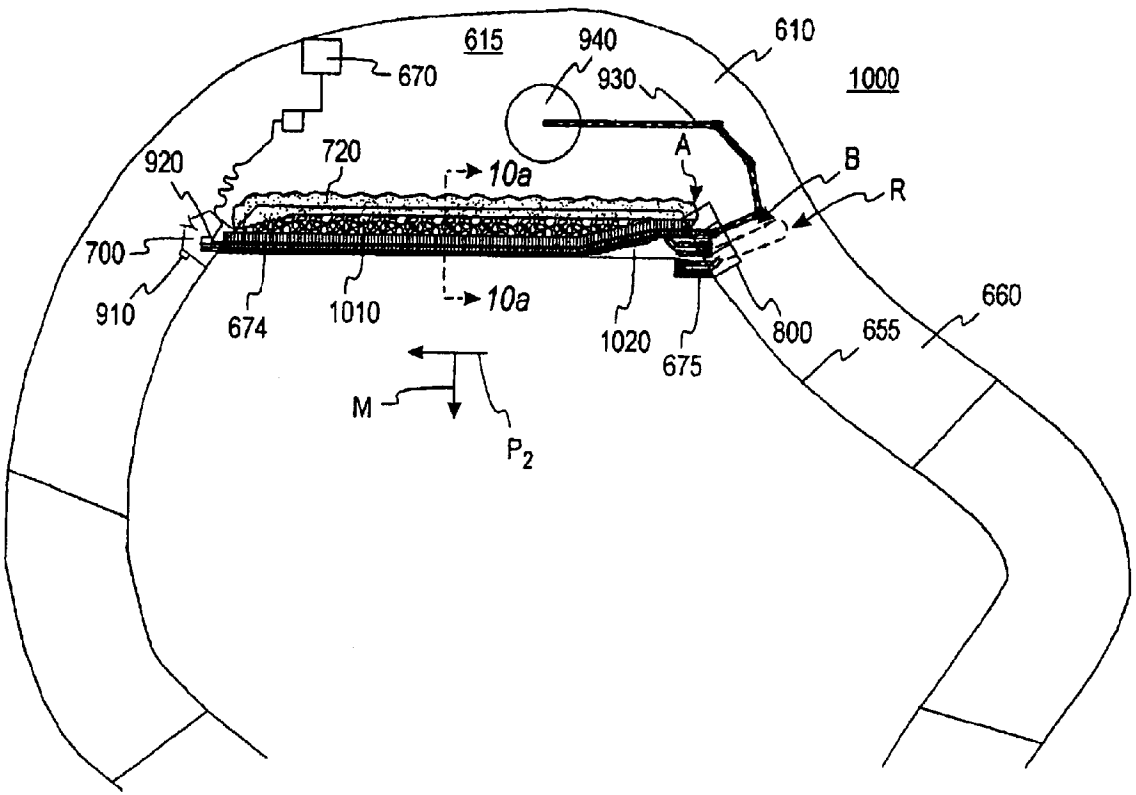
FIG. 10 is a top plan view of an exemplary initial system reversal phase according to one embodiment of the present invention, which follows the initial production phase of FIG. 9.

Referring now to FIG. 10, a top plan view of the second production phase 1000, which follows the initial production phase 900 of FIG. 9 is shown. In this phase 1000, gob 1010 behind the roof supports 674 has collapsed in the area behind the roof supports 674. The continuous miner 675 has progressed through the mineral seam 604 to the exhaust canopy 800 at the endgate area adjacent highwall 665 to complete a first production passage 1020, and, turned around as designated by the dashed-line path R, and has re-entered the mineral seam 604 for a second production cut in the direction of arrow P2. Because the mining equipment does not need to be removed and repositioned at highwall 655 due to the innovations of the present invention, significant cost savings and efficiency increases are realized through the elimination of downtime, the reduction in manpower, and the existing location for beginning of the second production cut indicated by arrow P2. In accordance with these advantages, the exhaust canopy 800 has been moved from position A to position B to account for the first production cut (FIGS. 10 and 10A) through the mineral seam 604. The roof supports 674 behind the continuous miner 675 have advanced into the mineral seam 604 in the direction indicated by arrow M to support the roof in the area behind the continuous miner 675. The ventilation fan 910 is reversed upon re-entry of the continuous miner 675 to facilitate ventilation in the proper direction. Mine spoil 720 continues to be placed along the opposing highwalls 655, 665 in the area recently mined to maintain the air seal.

Figure 10A:
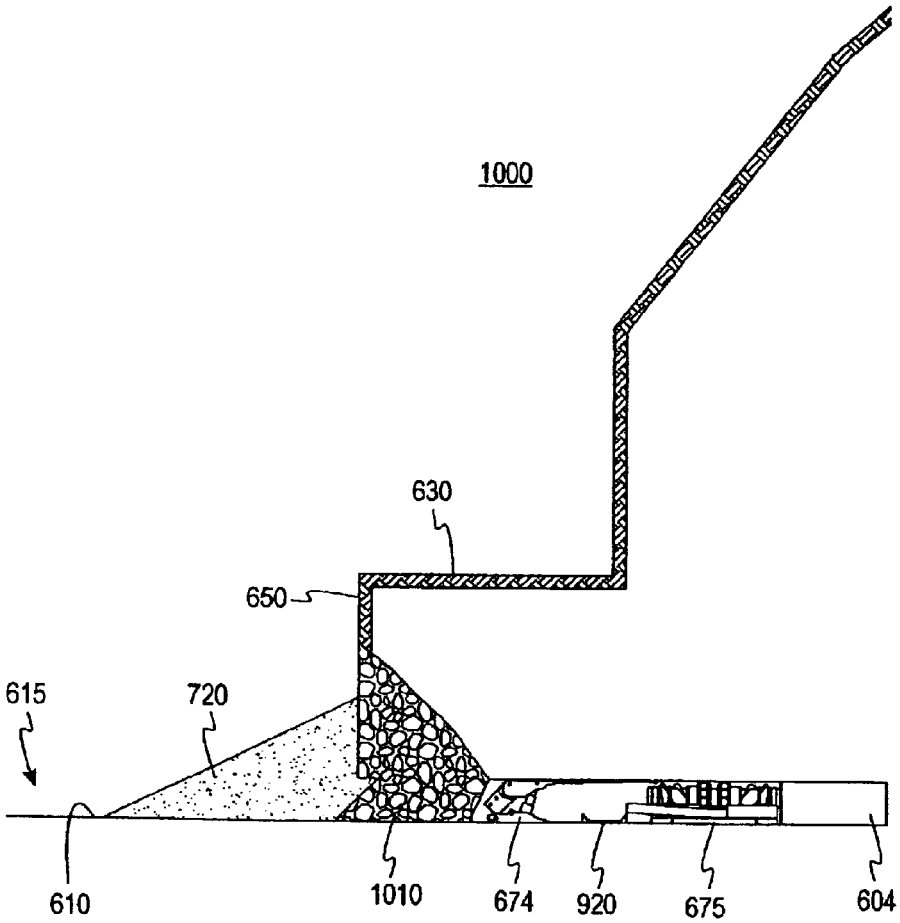
FIG. 10A is a cross-sectional view taken along line 10A—10A of FIG. 10.

Referring now to FIG. 10A, a cross-section of the second production phase 1000 taken along line 10A—10A of FIG. 10 is shown. The original air seal created by the mine spoil 720 is shown in the same position relative to the equipment insertion highwall, however, the gob 1010 is shown collapsed behind the roof supports 674. The collapse of the gob 1010 behind the roof supports 674 further facilitates formation of an air seal between the intake canopy 700 and exhaust canopy 800 adjacent the mineral seam 604 where the continuous miner 675 is operating. In this regard, it can be appreciated that no mountaintop removal is required, as the mountaintop collapses to form the gob 1010, with strata above the gob 1010 bending or breaking but not completely collapsing, thereby eliminating the need to transport portions of the mountaintop that are removed in prior systems. This in combination with continual use of the mine spoil 720 as the continuous miner 675 advances into the mineral seam 604 equates to tremendous reductions in environmental impact, yet complete or almost complete recovery of the mined material.

Figure 11:
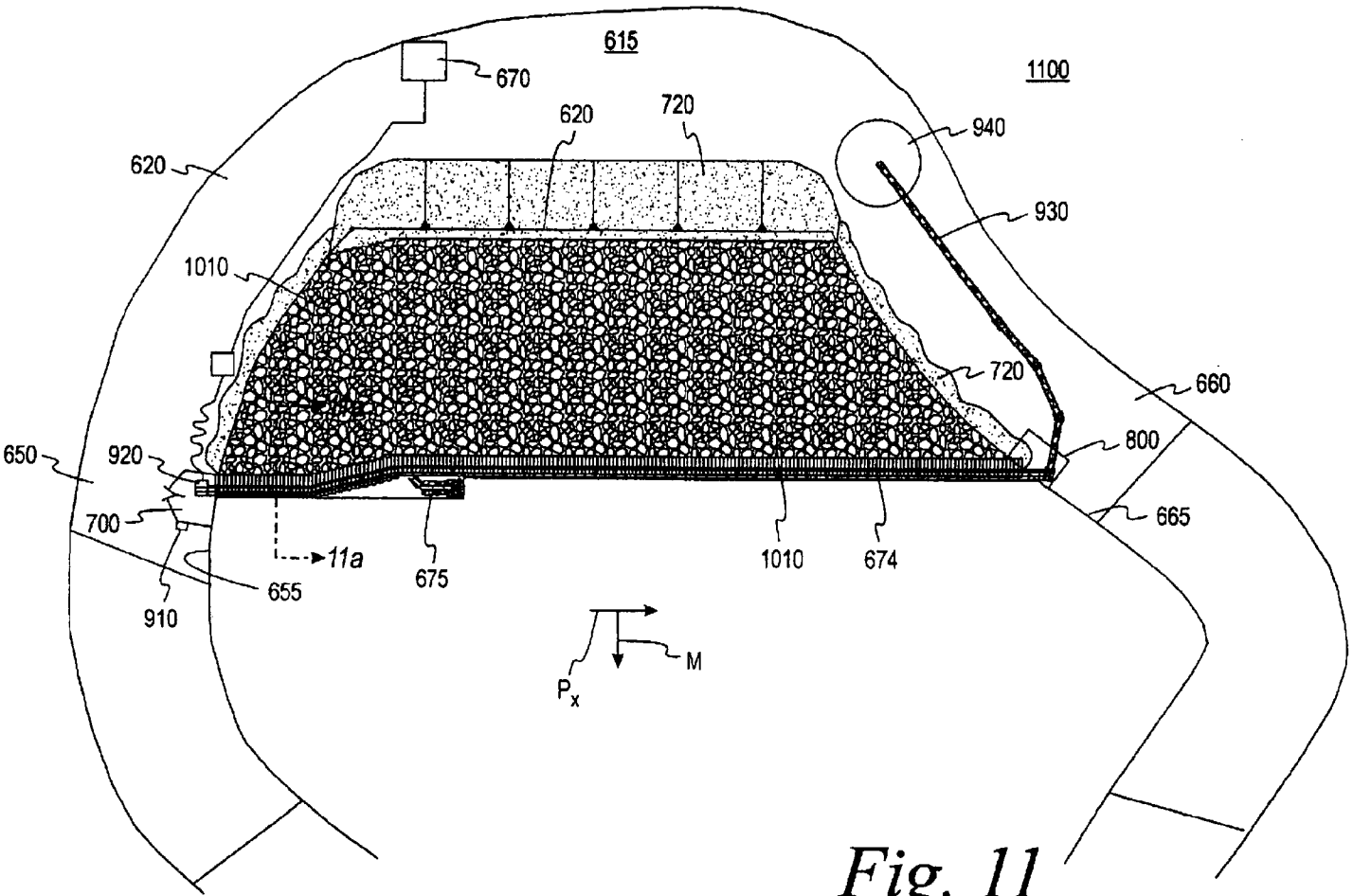
FIG. 11 a top plan view of a full production phase according to one embodiment of the present invention, which follows the initial system reversal phase of FIG. 10.

Referring now to FIG. 11, a top plan view of a continuing production phase 1100, which follows the second production phase 1000 of FIG. 10 is shown. The continuous miner 675 has advanced significantly into the mineral seam 604 at this point of the phase 1100 in the direction indicated by arrow M. Production occurs in the direction of the line indicated by arrow $P_x$. Mine spoil 720 has been used to backfill the equipment insertion highwall 620 adjacent the equipment staging area 615 and along opposing highwalls 655, 665 up to the area recently mined to allow reclamation of the mining area with minimal environmental impact. The backfilling will continue as the continuous miner 675 advances further into the mineral seam 604. For example, in this phase 1100 mine spoil 720 has been placed along opposing highwalls 655, 665 to facilitate formation of the air seal and deposit the fill material thereby allowing recovery in short 200' to 500' sections to approximate original contour without creating waste. Accordingly, recent legislative and judicial decisions restricting the types of waste created no longer apply to the present invention, unlike prior systems. The present invention thus accounts not only for mountaintop removal waste through the allowability of gob collapse behind areas recently mined by the continuous miner 675, but also accounts for mine spoil 720 created by providing a placement and use which improves mining efficiency and production. The intake canopy 700 and exhaust canopy 800 have each been advanced along substantially opposing highwalls 655, 665 of the mineral seam 604. The gob 1010 has formed due to overburden collapse rather than removal and fill, as required in prior systems in the areas behind the roof supports 674 recently mined by the continuous miner 675, thereby offering significantly less environmental impact than prior systems.

Figure 11A:
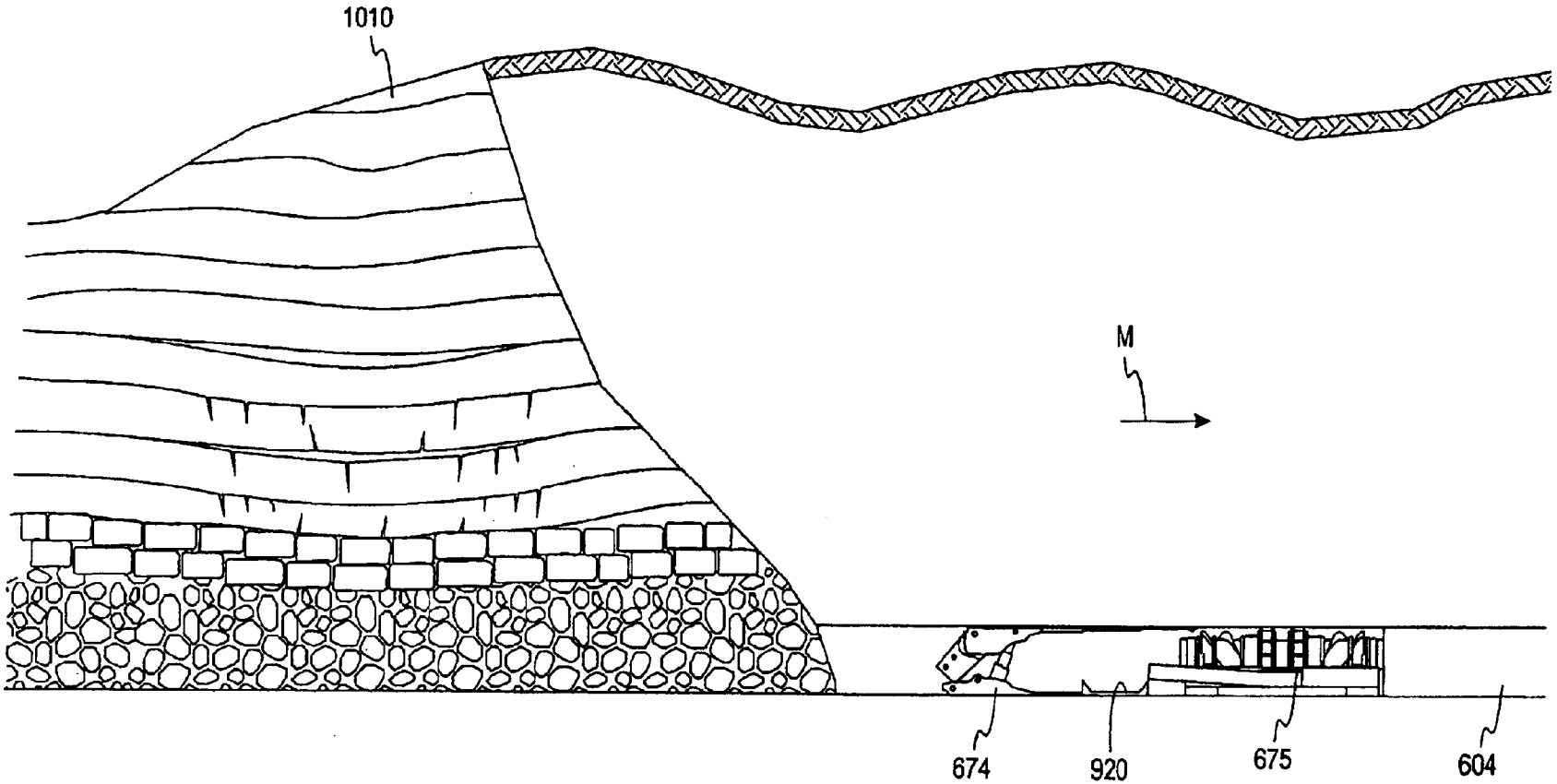
FIG. 11A is a cross-sectional view taken along line 11A—11A of FIG. 11.

Referring now to FIG. 11A, a cross-section of the continuing production phase 1100 taken along line 11A—11A of FIG. 11 is shown. The gob 1010, which represents material that did not have to be removed during the mining operation is shown as collapsed in the area behind the roof supports 674. The continuous miner 675, roof supports 674, and conveyor system 920 are shown as advanced into the mineral seam 604 in the direction indicated by arrow M.

Figure 12:
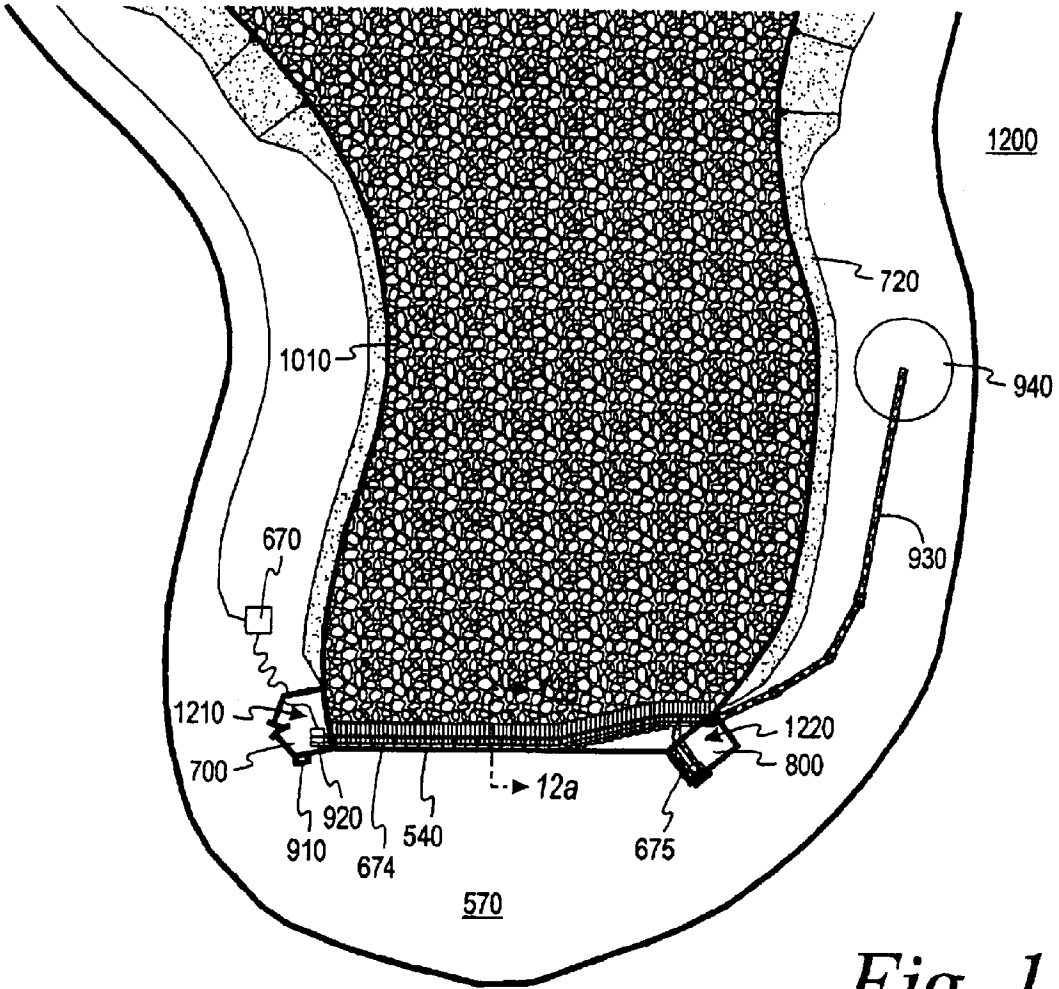
FIG. 12 is a top plan view of an equipment extraction phase according to one embodiment of the present invention, which follows the full production phase of FIG. 11.

Referring now to FIG. 12, a top plan view of an equipment extraction phase 1200, which follows the continuing production phase 1100 of FIG. 11 is shown. In the extraction phase 1200, the continuous miner 675 has reached an equipment extraction highwall 540, adjacent an equipment extraction area 590 between endgate 1210 and endgate 1220. The canopies 700, 800 have been advanced to endgates 1210, 1220 to assist in ventilation and removal and repositioning of the continuous miner 675. During this phase 1200, the continuous miner 675 makes its final cut through the mineral seam 604 and exits the mineral seam 604 via the exhaust canopy 800. It is contemplated that the orientation of the final cut may be reversed, depending on the size of the mineral seam 604 and the position of the continuous miner 675 in the next-to-last cut. The gob 1010 is completely collapsed and re-fills the recently mined area, and mine spoil 720 continues to be used to reclaim the area recently mined. Strata above the gob 1010 may break and bend, but does not completely collapse. In fact, when viewed from the surface, external surfaces of the mountaintop show little to no signs of underground mining operations conducted in accordance with the principles of the present invention. The power substation 670 has advanced with the continuous miner 675 to provide a continuous power supply to the system. It can clearly be seen that the removal of the continuous miner 675 may be achieved with little effort due to the location of the intake canopy 700, exhaust canopy 800, and methods as described above. Tremendous cost savings and increases in production efficiency are thus achievable with little to no environmental impact.

Figure 12A:
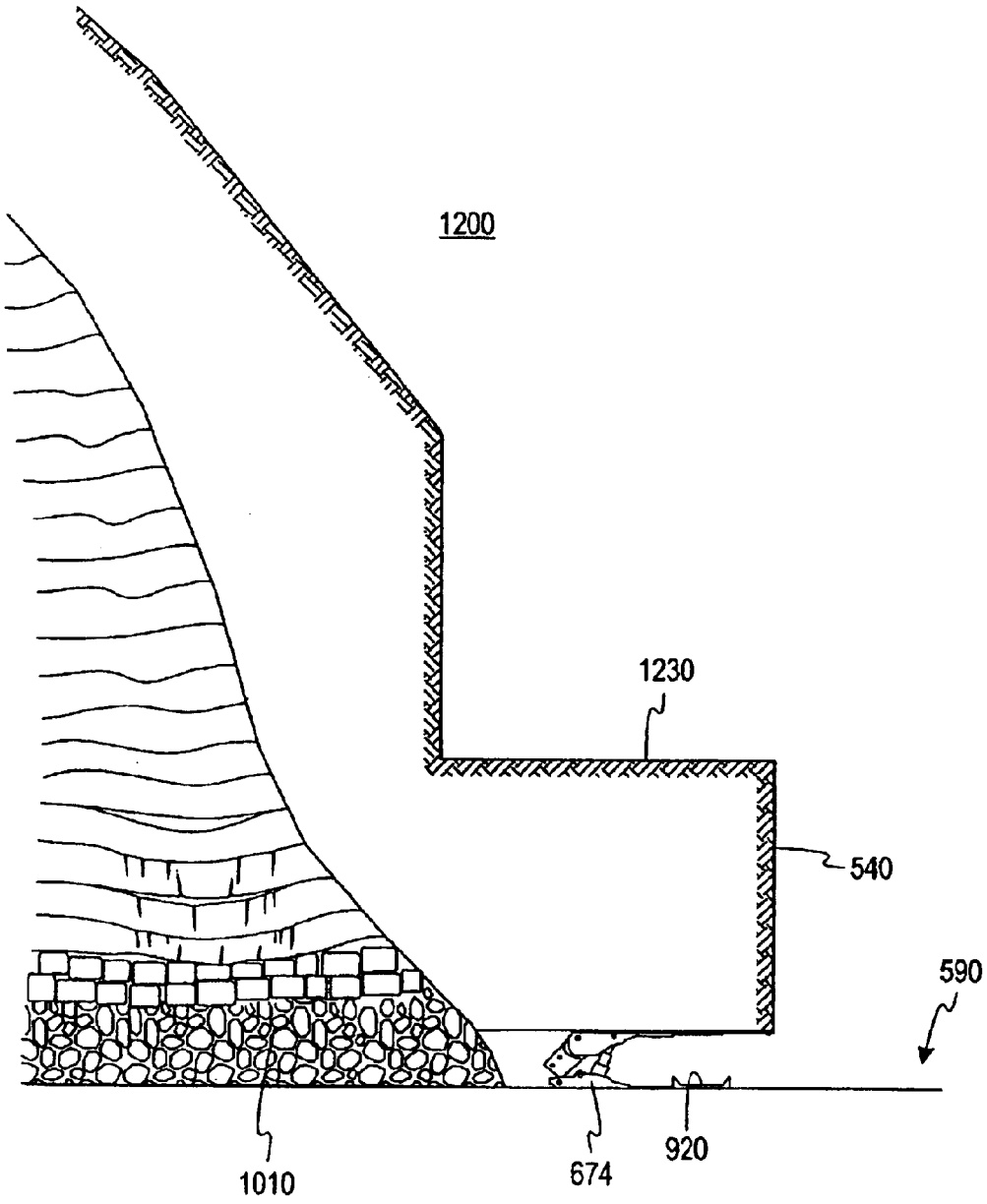
FIG. 12A is a cross-sectional view taken along line 12A—12A of FIG. 12.

Referring now to FIG. 12A, a cross-section of the phase 1200 taken along line 12A—12A of FIG. 12 is shown. The roof supports 674 are shown supporting the equipment extraction highwall 540 and safety bench 1230 during the final cut and removal of the continuous miner 675, conveyor 920 and roof supports 674.

Figure 13:
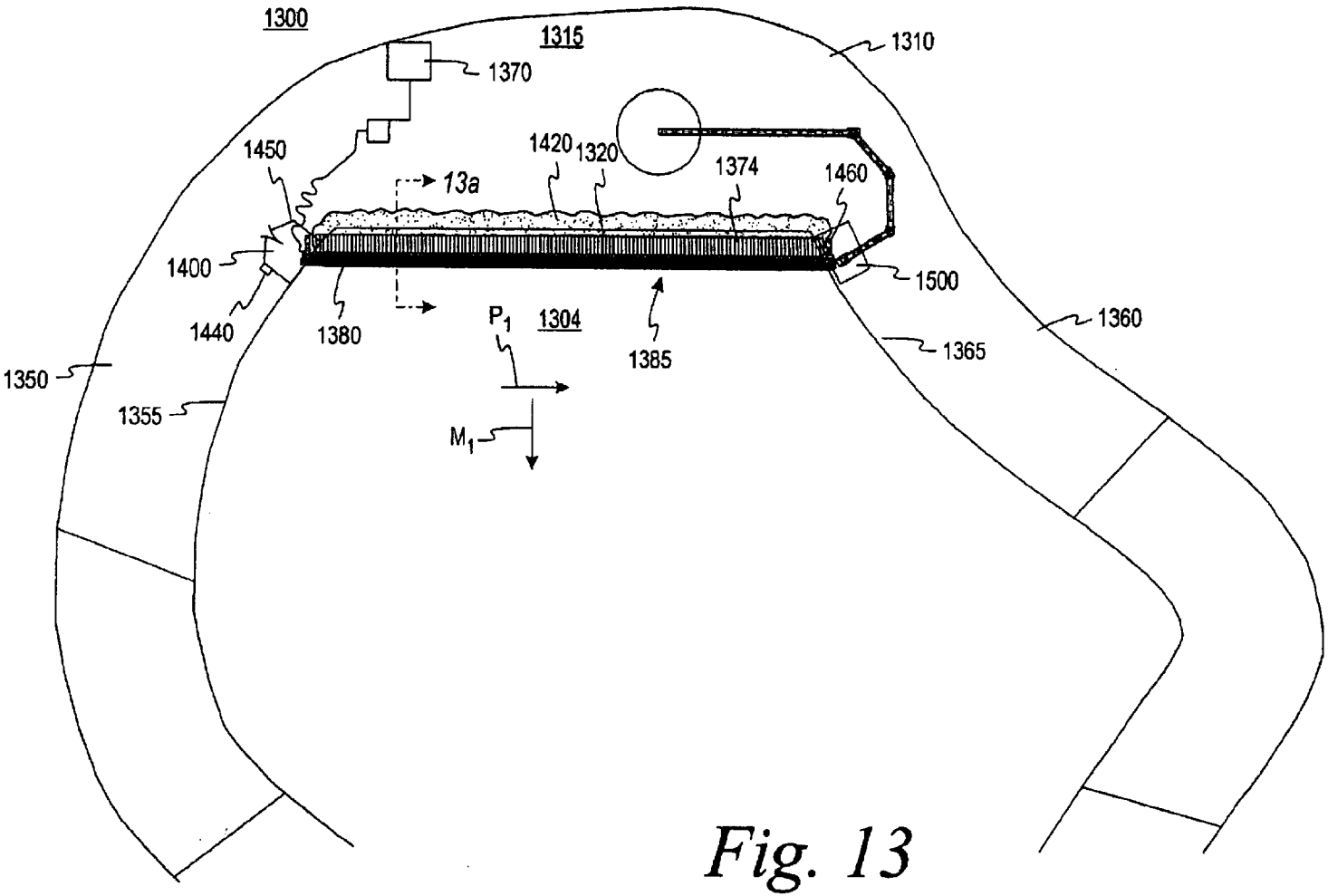
FIG. 13 is a top plan view of an embodiment of the present invention utilizing a longwall miner.

Referring specifically to FIG. 13, a top plan view of an first production cut 1300 for an exemplary longwall mining system is shown. As described above, the longwall mining system shares many similarities to the shortwall mining system discussed above. For example, prior to the first production cut 1300, a staging bench 1310 is first formed after contour mining the mineral seam 1304 in accordance with the principles discussed above. An equipment staging area 1315 is formed at an insertion highwall 1320. As described above, the contour mining includes a stable highwall, which are also referred to as endwalls, and bench area on both sides of the equipment staging area 1315, i.e. the bench 1350 and highwall 1355 on one side, and the bench 1360 and highwall 1365 on the other side. The opposing highwalls 1355, 1365 in the area being mined operate as endgates, and may function as either a headgate or a tailgate, described hereinabove, for the mining system depending on the direction of production travel. This is an important advantage, as the invention described herein eliminates the necessity of independent headgates or tailgates required by prior art systems, which reduces mining costs considerably. A power substation 1370 may be set up in the equipment staging area 1315 to provide power to various parts of the system.

Prior to the first production cut 1300 of the longwall mining system, a continuous miner (not shown) makes initial cuts in the mineral seam 1304 to form a starter entry 1380 in the manner described above with respect to the shortwall mining system. After several successive cuts are made beginning at the starter entry 1380, and moving from one highwall 1355 to the opposing highwall 1365, an insertion passage 1385 is formed. Roof supports 1374 are placed behind the area mined by the continuous miner in a manner described above. An intake canopy 1400 and an exhaust canopy 1500 are placed at the substantially opposing highwalls 1355, 1365 as defined by the insertion highwall 1320.

Mine spoil 1420 developed during creation of the access bench 1350, 1360 is placed on and around the roof supports 1374 to complete the formation of the starter passage 1385. This use of excess mine spoil 1420, which effectively seals the starter passage 1385 and creates a ventilation pathway within the starter passage 1385 eliminates the need to transport the mine spoil 1420 to disposal locations. This expedient use of the mine spoil 1420 complies with recent court decisions, particularly those involving the Clean Water Act, by providing an immediate use for the mine spoil 1420, as opposed to prior systems which typically dispose of mine spoil 1420 within valley fills. Accordingly, an immediate benefit of the present invention is to eliminate the need for disposal locations by placement and use of the mine spoil 1420 generated during the mining process.

In the first production cut 1300, after the starter passage 1385 has been created in the manner described above, a longwall miner 1375 is placed within the starter passage 1385 and proceeds to cut into the mineral seam 1304 in the direction indicated by arrow $M_1$, but in smaller increments than that for the continuous miner described above, into the mineral seam 1304. Production occurs in a direction indicated by arrow $P_L$. Cutting bits on the longwall miner 1375 are oriented in a direction parallel to $M_1$. As successive cuts are made into the mineral seam 1304, the roof supports 1374 are advanced into the recently mined area. Ventilation is provided through the use of a ventilation fan 1440 coupled to the intake canopy 1400. Ventilation thus occurs between opposing highwalls 1355, 1365 beginning at endgate 1450 and proceeding towards endgate 1460. It is appreciated that ventilation orientation may be reversed, depending on the circumstances. Because the longwall miner 1375, upon reaching endgate 1450, does not have to leave the cutting area of the mineral seam 1304, once the first production cut 1300 has been completed, additional cuts may be made with decreases in downtime due to the elimination of equipment relocation.

Figure 13A:
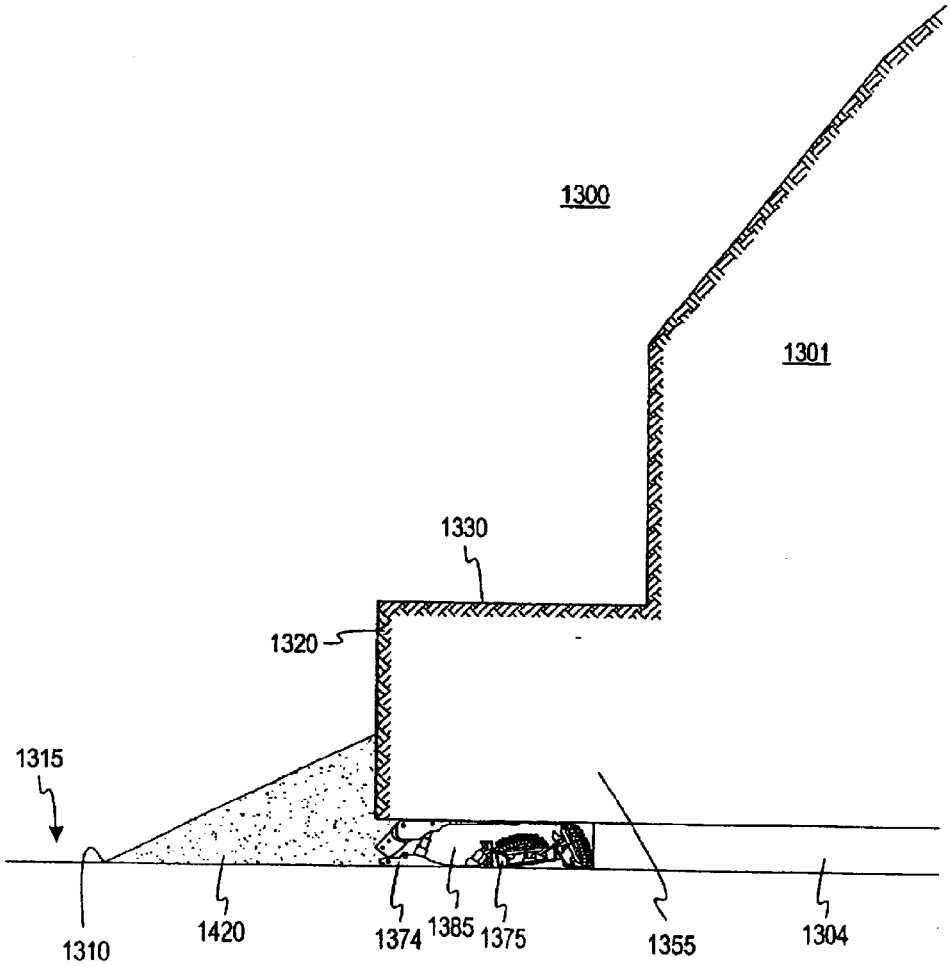
FIG. 13A is a cross-sectional view taken along line 13A—13A of FIG. 13.

Referring now to FIG. 13A, a cross-section of the first production cut 1300 taken along lines 13A—13A of FIG. 13 is shown. The staging bench 1310 is shown formed below the equipment insertion highwall 1320. A safety bench 1330 is shown formed adjacent the equipment insertion highwall 1320 and the existing mountaintop 1301. The mine spoil 1420 is shown surrounding the starter entry 1380 adjacent the roof supports 1374 as the longwall miner 1375 completes cuts between the highwall 1355 and opposing highwall 1365 (FIG. 13). The mine spoil 1420 creates an effective seal of the starter passage 1385, which allows proper ventilation of the starter passage 1385 and successive cuts into the mineral seam 1304. Roof supports 1374 are shown in the starter passage 1385 adjacent to the mineral seam 1304 and supporting the safety bench 1330 in the area adjacent the equipment insertion highwall 1320. As can be seen, the roof supports 1374 have been advanced into the area mined by the longwall miner 1375.

The present invention provides many advantages over prior mining systems. These include advantages as compared to conventional underground longwall/shortwall systems and advantages as compared to conventional surface mining operations. With respect to conventional underground longwall/shortwall systems, the mining system of the present invention operates from continuous surface access, and does not require panel formation, headgate and tailgate entries, shuttle cars, roof bolter, scoop and a personnel carrier. Estimated capital cost reductions of about 25–30% over conventional longwall systems and about 15–20% reduction over conventional shortwall systems of equivalent production capacity may be realized. Second, directly proportional to the reduction in equipment requirements discussed above is a reduction in manpower requirements, which results in an estimated personnel cost reduction of about 30–40% over conventional longwall systems and about 20–30% over conventional shortwall systems of equivalent production capacity. Third, due to the reductions in personnel requirements, the reduction in travel time to the mineral seam and the elimination of panel moves results in about a 10–15% increase in production. Finally, through the unique and novel combination of surface and underground mining technologies and the elimination of underground development entries, the present invention may achieve nearly 100% recovery of the mineable resources, a tremendous improvement in the typical 75–85% overall recovery achieved in conventional longwall and shortwall systems.

As compared to conventional surface mining operations, similar efficiency increases and production increases are realized. First, the present invention requires a relatively small bench area due to the relatively small earthmoving equipment as compared to the larger equipment required in conventional surface mining operations. Second, manpower requirements are greatly reduced due to the reduction in equipment requirements as compared to the conventional large-scale surface mining operations, which results in about a 10–20% personnel cost reduction over conventional surface mining systems of equivalent production capacity and resource recovery potential. This results in a proportional increase in productivity (on a tons per man-hour basis) of about 10–20%. Fourth, because the present invention may achieve about 100% recovery of the mineable resource, this is equivalent to recovery achieved by large-scale mountain top removal operations and significantly better than the typical 65–85% recovery achieved in conventional surface/auger or surface/highwall-miner systems. Finally, because of the small surface mining bench requirement which is subsequently completely reclaimed to approximate original contour, the surface disturbance and associated environmental impacts are significantly less than those associated with typical large-scale surface mining (especially mountain top removal) operations. Such improvement results in about a 70% reduction in total surface area disturbance as compared to mountain top removal operations.

Other advantages include the elimination of the need for large valley fills and in-stream sediment ponds. If blasting is necessary, the number and size of blasts are greatly reduced. Safety is ensured through the use of the roof supports, canopies or other shields.

Importantly, federal legislation (i.e. the Clean Water Act) and judicial decisions have raised concerns of many miners in the industry due to, among other things, restrictions placed on waste removal operations at the mining site. The present invention offers an economical, efficient and highly productive system, which complies with federal legislation and judicial systems by imposing little to no environmental impact at the mining area. This is accomplished through the principles discussed above, with particular emphasis on the elimination of unused mine spoil, which in the present invention is used to facilitate creation of an air seal and re-contour the exterior surface of the mine. This is further accomplished through the collapsing of the gob behind the longwall or shortwall miner, which eliminates the need to remove the gob after mining. Finally, it is important to note that the system of the present invention accomplishes these goals and advantages without compromising miner safety.

The previous description is of preferred embodiments for implementing the invention, and the scope of the invention should not necessarily be limited by this description. The scope of the present invention is instead defined by the following claims.

We claim:

1. A method for extracting mineral deposits in a mineral reserve comprising:

contour mining to expose at least a portion of the mineral reserve, thereby forming a highwall and a bench;

creating an insertion highwall in a portion of the highwall between a pair of endwalls; and extracting mineral deposits by mining from one endwall to another in a direction of production and advancing into the mineral reserve in a direction of mining substantially perpendicular to the insertion highwall.

2. The method of claim 1, wherein the step of advancing into the mineral reserve is accomplished by repeating the step of extracting mineral deposits by mining from one endwall to another.

3. The method of claim 2, wherein the direction of production for extracting mineral deposits during each subsequent pass from one endwall to the other endwall is reversed.

4. The method of claim 3, wherein the reversible direction of production is substantially parallel to the insertion highwall.

5. The method of claim 2, further comprising ventilating each successive passage formed by moving between the endwalls.

6. The method of claim 1, wherein the highwall is substantially straight between the endwalls.

7. The method of claim 1, wherein the step of extracting mineral deposits is accomplished using shortwall mining techniques.

8. The method claim 1, wherein the step of extracting mineral deposits is accomplished using longwall mining techniques.

9. The method of claim 1, further comprising providing roof support for mining equipment as minerals are extracted between the endwalls.

10. The method of claim 9, further comprising advancing roof support as mining continues in the direction of mining, whereby the roof collapses behind the roof supports.

11. A method for extracting mineral deposits in a mineral reserve accessible from a sloping surface, comprising:

mining the sloping surface to create a highwall, thereby forming a bench;

forming an insertion highwall in a portion of the highwall generally perpendicular to a desired direction of mining the mineral reserve, thereby forming endwalls on opposing ends of the insertion highwall;

cuffing a starter entry into the mineral reserve across the entire length of the insertion highwall between the endwalls; and inserting roof supports into the starter entry and backfilling a portion of the starter entry with spoil to form a starter passage between the endwalls.

12. The method of claim 11, further comprising:

successively mining the mineral reserve moving from one endwall to the other in a direction of production to extract mineral deposits therefrom thereby forming at least one successive passage advancing in the direction of mining; and providing roof support for successive passages resulting from the extraction of mineral deposits from the mineral reserve.

13. The method of claim 11, further comprising ventilating the starter passage at one of the endwalls.

14. The method of claim 11, further comprising:

positioning one canopy at one end of the starter passage adjacent an endwall; and positioning another canopy at the other end of the starter passage adjacent the other endwall.

15. The method of claim 14, further comprising coupling a reversible ventilation fan to at least one of the canopies to ventilate the starter passage.

16. The method of claim 11, wherein the step of mining the sloping surface is accomplished by contour mining.

17. The method of claim 11, wherein the bench is adapted to support mining equipment.

18. The method of claim 11, further comprising: creating at least one power substation disposed on the bench to provide power to mining equipment.

19. The method of claim 11, wherein the roof supports are inserted via a shield carrier.

20. The method of claim 11, further comprising:

forming a safety bench above the insertion highwall and parallel to the bench.

21. The method of claim 12, further comprising:

conveying the mineral deposits from the mineral reserve to a stockpile.

22. The method of claim 11, wherein the backfilling occurs along the roof supports and endwalls to create an air seal along the insertion highwall between opposing endwalls.

23. The method of claim 11, wherein the insertion highwall is generally straight between the opposing endwalls.

24. A method for extracting mineral deposits in a mineral reserve accessible from a sloping surface, comprising:

mining the sloping surface to create a highwall, thereby forming a bench;

forming an insertion highwall in a portion of the highwall generally perpendicular to a desired direction of mining the mineral reserve, thereby forming endwalls on opposing ends of the insertion highwall;

successively mining the mineral reserve moving from one endwall to the other in a direction of production to extract mineral deposits therefrom, thereby forming at least one successive passage advancing in the direction of mining; and providing roof support for successive passages resulting from the extraction of mineral deposits from the mineral reserve.

25. The method of claim 24, wherein the direction of production reverses direction between the endwalls for successive passages.

26. The method of claim 24, wherein the bench and highwall extend a first predetermined distance from the insertion highwall to form a first mining stage for mining a first predetermined number of successive passages, and further comprising:

mining the mineral reserves using the first mining stage to extract mineral deposits from the first predetermined number of successive passages through the mineral reserve.

27. The method of claim 26, further comprising:

extending the bench and highwall a second predetermined distance from the first predetermined distance to form a second mining stage for mining a second predetermined number of successive passages; and backfilling the first mining stage to recontour the surface with spoil resulting from mining the sloping surface of the second mining stage.

28. The method of claim 24, further comprising:

ventilating at least one of the successive passages at one of the endwalls of the successive passage.

29. The method of claim 24, further comprising:

positioning one canopy at one endwall and another canopy at the other endwall to provide safe access to the successive passage.

30. The method of claim 29, further comprising:

coupling a reversible ventilation fan to at least one of the canopies.

31. The method of claim 30, further comprising:

reversing the reversible ventilation fan after creation of each successive passage.

32. The method of claim 29, wherein the canopies are mobile.

33. The method of claim 32, wherein the step of successively mining the mineral reserve is accomplished by a miner, and further comprising:

removing the miner from the successive passage through one of the canopies at one of the endwalls after creation of the successive passage;

reversing the orientation of the miner;

reversing the orientation of the ventilation; and re-inserting the miner into the mineral reserve adjacent the completed successive passage through the one of the canopies at one of the endwalls.

34. The method of claim 33, further comprising:

advancing the canopies along the endwalls after creation of the successive passage.

35. The method of claim 33, further comprising:

backfilling the created successive passages with spoil.

36. The method of claim 24, further comprising:

allowing gob behind the roof supports to collapse in an area behind the roof supports after the step of providing roof support for successive passages.

37. The method of claim 24, further comprising:

forming a surface in the highwall generally perpendicular to the desired direction of mining the mineral reserve to create an extraction highwall between opposing endwalls of the highwall extending therefrom, the extraction highwall being on a generally opposite side of the mineral reserve from the insertion highwall.

38. The method of claim 37, further comprising:

mining the mineral reserve moving from one endwall to the other in the direction of production to continue extracting mineral deposits therefrom thereby forming an extraction passage;

removing mining equipment from the extraction passage; and re-contouring an extraction highwall formed adjacent the extraction passage to proximate an original contour of the sloping surface.

39. The method of claim 24, further comprising:

manually advancing the roof supports in the direction of mining after the creation of each successive passage.

40. The method of claim 24, wherein the step of mining the sloping surface is accomplished by contour mining.

41. The method of claim 24, wherein the bench is adapted to support mining equipment.

42. The method of claim 24, further comprising:

creating at least one power substation disposed on the bench to provide power to mining equipment.

43. The method of claim 42, wherein the at least one power substation is mobile.

44. The method of claim 43, further comprising:

advancing the at least one power substation in the direction of mining relative to the step of successively mining the mineral reserves.

45. The method of claim 24, wherein the roof supports are inserted via a shield carrier.

46. The method of claim 24, further comprising:

forming a safety bench above the insertion highwall and parallel to the bench.

47. The method of claim 24, further comprising:

conveying the mineral deposits from the mineral reserve to a stockpile.

48. The method of claim 24, wherein the insertion highwall is generally straight between the opposing endwalls.

* * * * *